United States Patent [19]

Garner

[11] 4,359,335

[45] Nov. 16, 1982

[54] METHOD OF FABRICATION OF ROCK BIT INSERTS OF TUNGSTEN CARBIDE (WC) AND COBALT (CO) WITH CUTTING SURFACE WEAR PAD OF RELATIVE HARDNESS AND BODY PORTION OF RELATIVE TOUGHNESS SINTERED AS AN INTEGRAL COMPOSITE

[75] Inventor: Lloyd L. Garner, Dana Point, Calif.

[73] Assignee: Smith International, Inc., Newport Beach, Calif.

[21] Appl. No.: 156,717

[22] Filed: Jun. 5, 1980

[51] Int. Cl.[3] ..... B22F 7/00; C04B 35/56; E21B 9/36; E21C 35/18

[52] U.S. Cl. ..... 75/208 R; 51/309; 75/204; 75/200; 76/108 A; 76/DIG. 11; 175/410; 175/379; 299/79; 428/547; 428/550; 428/551; 428/552; 428/698; 501/87

[58] Field of Search ..... 75/208 R, 204, 200; 76/DIG. 11, 108 A; 428/698, 547, 550, 551, 552; 51/309; 175/410, 379; 501/87

[56] References Cited

U.S. PATENT DOCUMENTS

| | | | |
|---|---|---|---|
| 2,108,797 | 2/1938 | Comstock | 76/DIG. 11 |
| 2,888,247 | 5/1959 | Haglund | 175/379 |
| 3,581,835 | 6/1971 | Stebley | 76/108 A X |
| 3,677,722 | 7/1972 | Rymas | 75/204 X |
| 3,790,353 | 2/1974 | Jackson et al. | 51/309 X |
| 3,882,749 | 5/1975 | Tourek | 175/379 X |
| 3,937,618 | 2/1976 | Kirkham | 75/208 R X |
| 3,999,954 | 12/1976 | Kolaska et al. | 75/208 R X |
| 4,082,559 | 4/1978 | Mishuku et al. | 75/208 R X |
| 4,194,790 | 5/1980 | Kenny et al. | 51/309 X |
| 4,202,419 | 5/1980 | Youngblood | 175/410 X |
| 4,203,496 | 5/1980 | Baker et al. | 175/410 X |
| 4,289,833 | 9/1981 | Hachisuka | 75/208 R X |

FOREIGN PATENT DOCUMENTS

| | | | |
|---|---|---|---|
| 2810746 | 9/1979 | Fed. Rep. of Germany | 75/208 R |

*Primary Examiner*—Helen M. McCarthy
*Attorney, Agent, or Firm*—Robert G. Upton

[57] ABSTRACT

A method of fabricating a rock bit insert which has improved wear characteristics is disclosed. Selected surfaces of the insert are implanted with a harder grade of tungsten carbide and sintered thereto. The special insert then would find application in the gage row of, for example, a roller cone rock bit.

2 Claims, 8 Drawing Figures

METHOD OF FABRICATION OF ROCK BIT INSERTS OF TUNGSTEN CARBIDE (WC) AND COBALT (CO) WITH CUTTING SURFACE WEAR PAD OF RELATIVE HARDNESS AND BODY PORTION OF RELATIVE TOUGHNESS SINTERED AS AN INTEGRAL COMPOSITE

BACKGROUND OF THE INVENTION

1. Field of the Invention

This invention relates to methods of fabricating rock bit inserts having a varying degree of hardness on selected surfaces of the insert.

More particularly, this invention relates to the fabrication of tungsten carbide inserts having one cutting surface harder than an adjacent cutting surface, the insert being designed to be interference fitted into a gage row of a cone of a roller cone rock bit.

In the drilling industry, maintenance of the gage circumference of a borehole is essential to prevent pinching of subsequent rock bits as they are lowered into the formation for continued drilling. If the gage row of inserts in a roller bit becomes worn, the rock bit begins to drill a borehole that is undersized. Tripping out the worn rock bit results in replacement of that rock bit with a new rock bit having a gage diameter that is larger than the gage of the borehole cut by the previous rock bit. Consequently, as the new rock bit is lowered into the formation it becomes pinched, resulting in either catastrophic failure of the rock bit or drastically reduced rock bit life.

2. Description of the Prior Art

It is well known in the prior art to provide hardened cutting tips for cutting tools such as those which are used in milling machines and the like. For example, U.S. Pat. No. 3,790,353, assigned to the same assignee of the present invention, describes a hardfaced wear pad usable, for example, by brazing the wear pad to a digger tooth to provide a hardened surface for the tooth. The tooth generally is fabricated from steel and the wear pad of tungsten carbide is brazed to the tip of the tooth. The tungsten carbide pad provides a hardened surface to prolong the life of the digger tooth.

A more recent U.S. Pat. No. 4,194,790 discloses a cutting tip insert of a rock cutting tool which comprises two hardened layers. The outside layer is at least several units harder on a hardness scale than the base layer. The layered cutting tip is conventionally brazed to the tip of an insert.

The foregoing prior art patents are disadvantaged in that a multi-step process is required wherein the hardened material has to be brazed or welded to the tips of the cutting instruments.

Yet another disadvantage comes to light in that while the hardened tips are applied metallurgically, the heat generated by most metallurgical methods could attack the integrity of the backup insert or cutting tool to the extent where the tool itself is flawed.

The present invention provides a method to fabricate a rock bit insert from tungsten carbide material with selected cutting surfaces of the insert having tungsten carbide of harder composition than the base insert material. The preferred method of fabrication would form a first layer or pad in a hydraulic ram type press and prior to final sintering, the pre-formed wear pad is inserted in a second insert die cavity. The less hard, somewhat tougher insert material is subsequently compacted against the wear pad by a second hydraulic press. The insert is then sintered, integrally mating the wear pad to the basic material of the insert. It is apparent then that there is no heat brazing or welding of one material to another material. The whole insert is integrally sintered, forming a one piece composite insert having desirable wear characteristics uniquely suited to cutting the gage of a borehole.

SUMMARY OF THE INVENTION

It is an object of this invention to provide a method to fabricate tungsten carbide inserts having selected cutting surfaces of the insert with harder wear characteristics than the remainder of the insert.

A method of fabricating a powder-metallurgically formed insert for a rock bit is disclosed. The insert has a portion of its cutting surface implanted with a material having selected wear characteristics. A wear pad die cavity is formed in a die that conforms to a shape representing the portion of the cutting surface having a material with selected wear characteristics. The material is then pressed into the wear pad die cavity. The wear pad is then removed from the die cavity in its unsintered state and positioned into a second insert die cavity formed in a second die to conform to the portion of the cutting surface of the insert that is to have the harder surface. Powdered metal is then hydraulically pressed into the second die cavity, the powdered metal having wear characteristics different than the wear pad. The completely formed insert is then removed from the second die cavity and placed in a furnace. The insert is then sintered in a furnace.

The powder-metallurgical product is a cemented carbide, such as, tungsten carbide. The tungsten carbide is produced in general by carburization of tungsten powder. The grain size of the tungsten carbide powder is typically two to seven microns. The tungsten carbide powder is then mixed with cobalt, the entire mixture being held together with, for example, a paraffin wax. Grade designations of tungsten carbide depend upon a ratio of tungsten carbide powder to cobalt. The mixture is then compacted or pressed into a die cavity by a hydraulic ram press with a pressure ranging from ten to thirty tons per square inch.

The final insert configuration that is pressed in the second die cavity is typically oversize to accommodate for shrinkage that will occur during the furnace curing or sintering process. Generally the inserts are in the furnace from one to four hours at a temperature of from 1300° to 1700° C.

An advantage then over the prior art hardened cutting tools is the method in which the insert is fabricated into an integral composite mass by positioning a selected material having special wear characteristics to a cutting surface of an insert and integrating the material of the insert to the wear pad and curing the entire composition as one integral piece.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
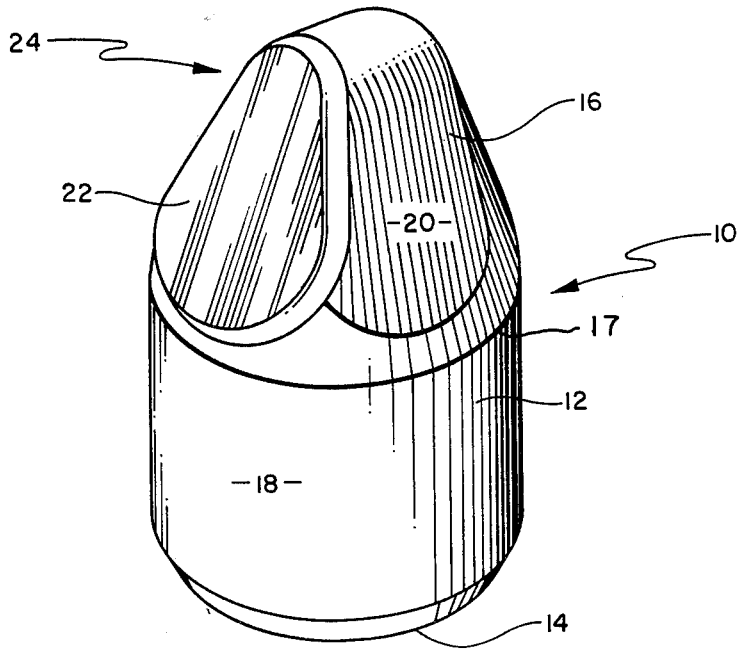
FIG. 1 is a perspective view of a gage row insert with a portion of the cutting end of the insert implanted with a hardened wear pad.

With reference to FIG. 1, the rock bit insert, generally designated as 10, is comprised of an insert body 12 with a cutting tip 16 at one end and a base end 14 at the opposite end. Each insert 10 has a grip length 18 between the base 14 and the end of the grip length portion 17. The type of insert depicted is known as a chisel insert with flats 20 on opposite sides of the cutting tip end 16. A surface 22 is cut in cutting tip 16 in which a hardened wear pad 24 is embedded.

Figure 4:
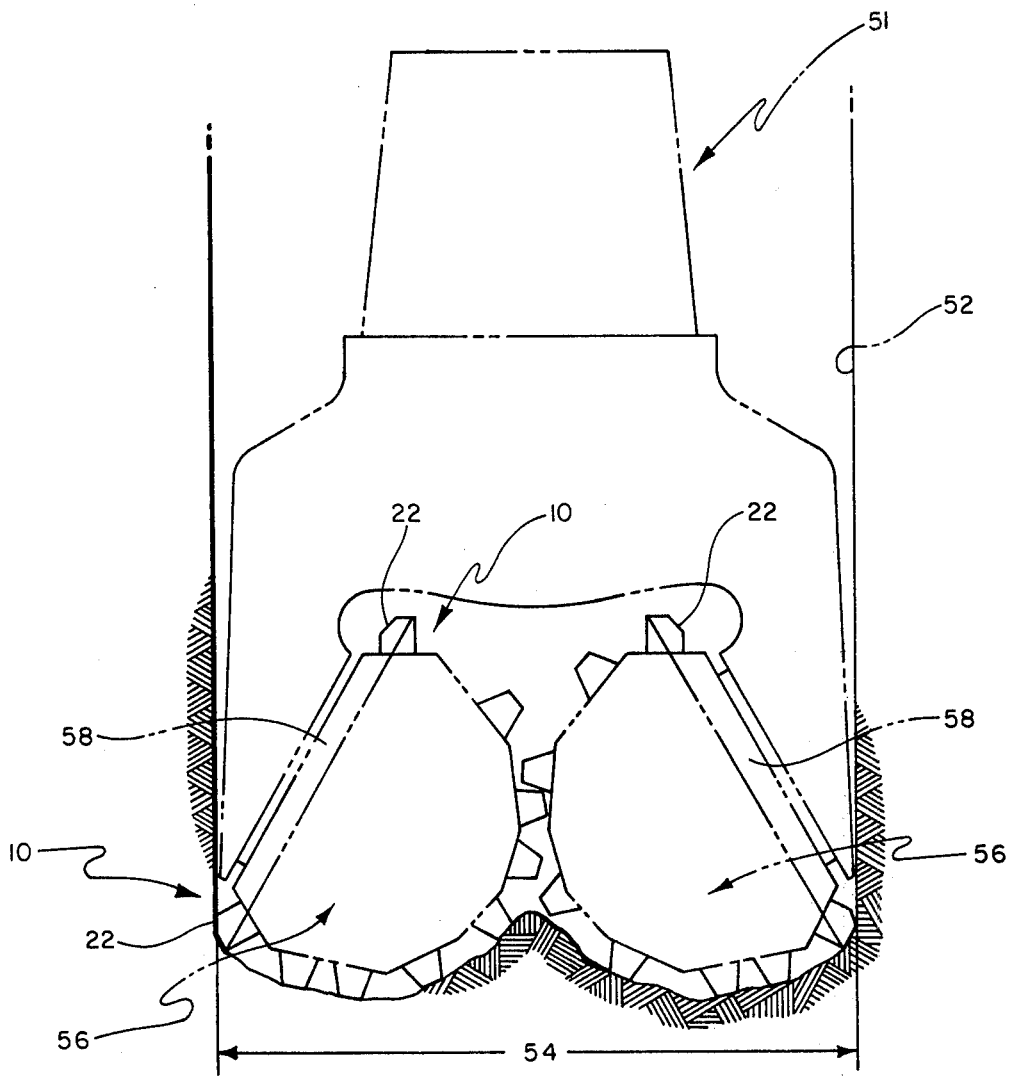
FIG. 4 is a side elevational view of a rock bit in a borehole.

Referring to FIG. 4, the gage row 58 of a roller cone 56 is configured somewhat differently. The inserts are oriented with their chisel point or crown in a radial direction from the center of the cone 56 and an additional surface 22 is slabbed off the cutting surface of the insert to provide a cutting edge 22 for the gage 54 of a borehole. The gage row 58 or outer row of interference fitted inserts in a typical roller cone rock bit 51 are subjected to excessive wear due to the fact that they are in continuous contact with the borehole gage surface 52 and, in fact, cut the gage 54 or circumference of the borehole. As indicated before, if these gage row inserts should become excessively worn the rock bit begins to cut an undersized borehole which results in pinching of subsequent bits as they are lowered into the hole.

Insert 10 is fabricated by forming a hardened wear pad, generally designated as 24 (FIG. 1), to be applied to or implanted with the base tungsten carbide material of the insert body 12.

Figure 2:
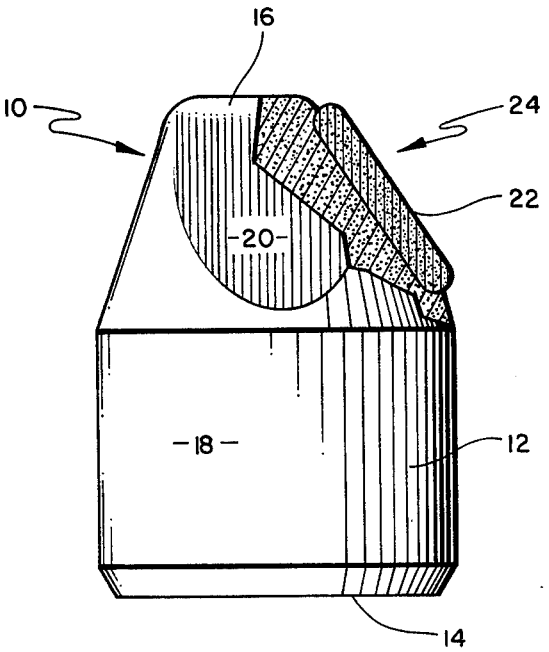
FIG. 2 is a partially cutaway, side elevational view of the gage row insert.

Referring now to FIG. 2, the partially cutaway side view of the insert illustrates the chisel flat 20 at tip 16 with an additional flat 22 formed about 90° to the flats 20 of the insert 10. It would be obvious however to apply the wear pad to the flats 20 of the insert or to any cutting surface of an insert.

Figure 3:
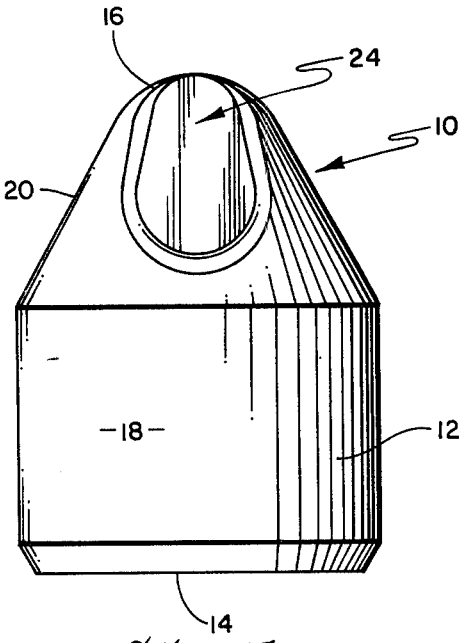
FIG. 3 is a side view of the insert rotated 90° from the side view of FIG. 2.

FIG. 3 illustrates the completely formed insert with the wear pad 24 imbedded in surface 22 of the tip 16 of the insert.

Figure 5:
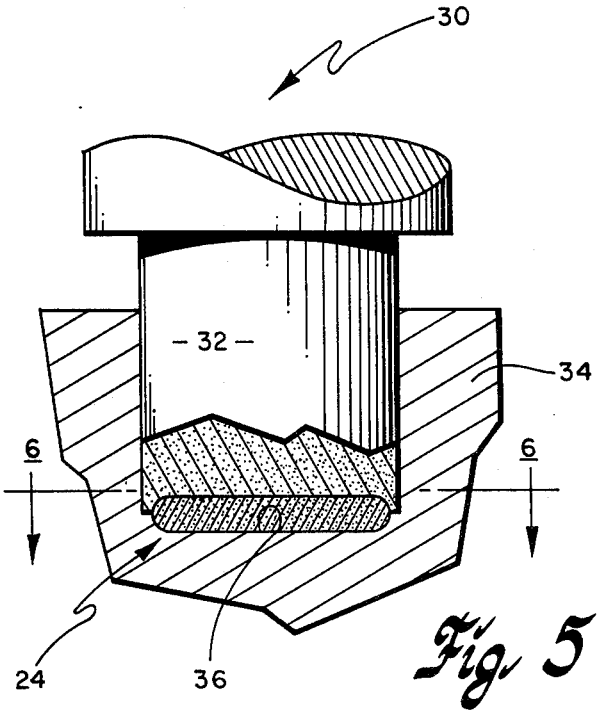
FIG. 5 is a partially cutaway, side elevational view of a die cavity used to form the hardened wear pad of the insert.

With reference to FIG. 5, a special wear pad die 34 forms a wear pad die cavity 36 to form the wear pad. In operation, tungsten carbide powder of harder composition than the material of the body 12 of the insert 10 is deposited into the cavity 36 formed in the wear pad die 34. A hydraulic press, generally designated as 30, drives a ram 32 into the die 34 thus pressing the wear pad 24 in the die. Typically, the tungsten carbide and cobalt are cemented together with a paraffin wax so that the unsintered wear pad 24 will retain its shape while the pad is imbedded or integrated into the parent material making up body 12 of the insert.

Figure 6:
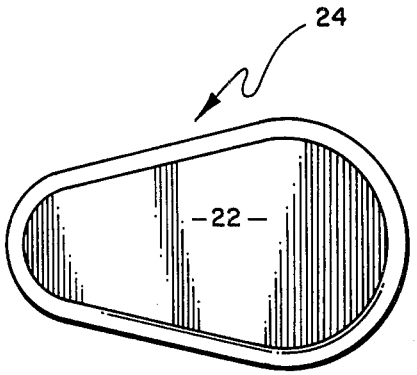
FIG. 6 is a view taken through 6—6 of FIG. 5.

FIG. 6 illustrates the formed unsintered wear pad 24 having surface 22 which conforms to the gage cutting edge of the insert 10.

Figure 8:
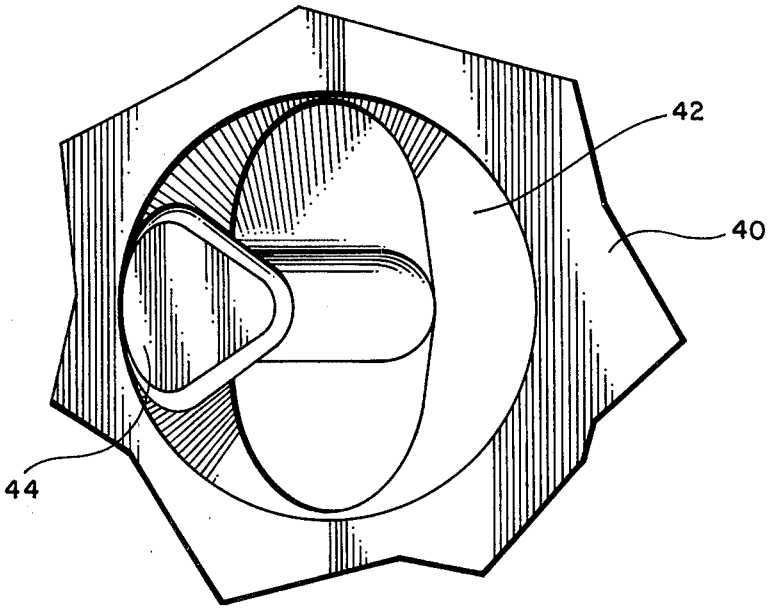
FIG. 8 is a view taken through 8—8 of FIG. 7.
Figure 7:
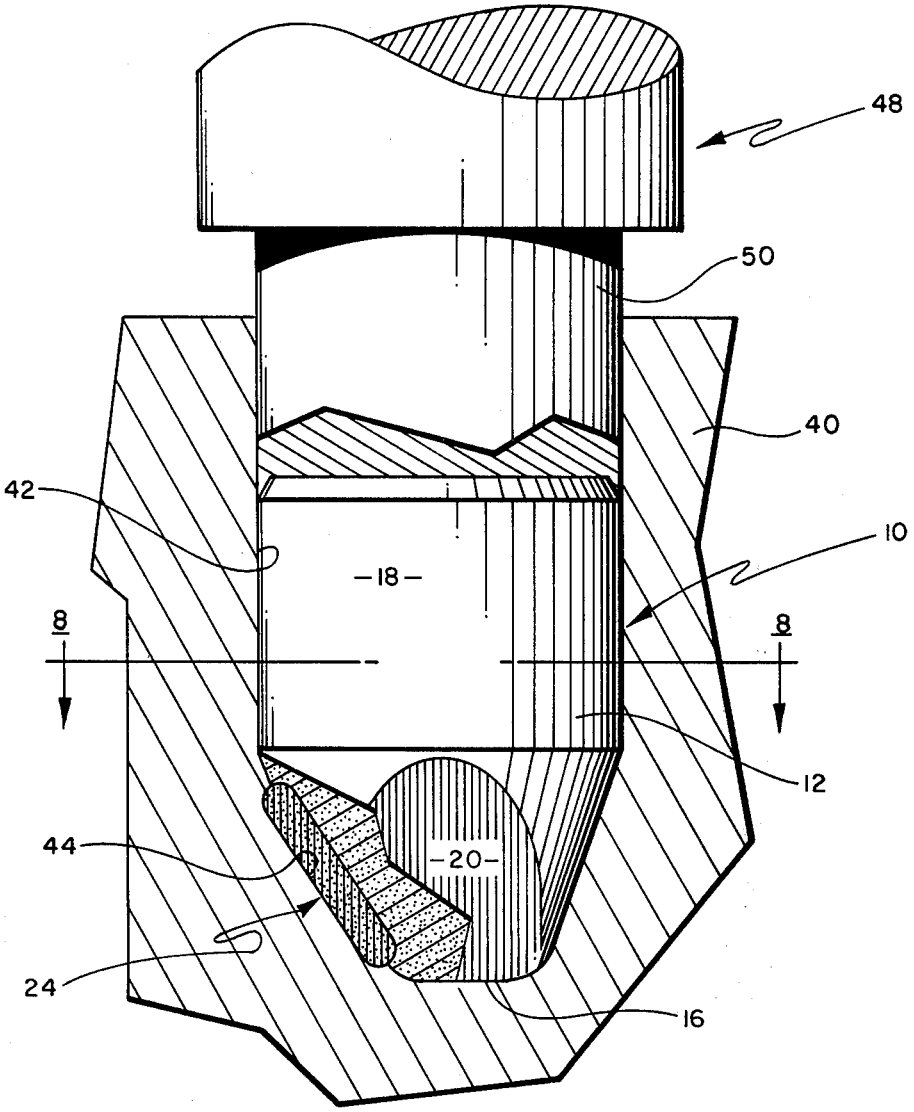
FIG. 7 is a partially cutaway, side elevational view of a second insert die cavity illustrating the completely formed insert with wear pad in place.

With reference to FIG. 7, the pre-formed wear pad 24 is subsequently placed in a second die 40 which forms a wear pad cavity 44 internally of the die 40. This is clearly seen in FIGS. 7 and 8. The pre-formed wear pad 24 is placed in the recess or cavity 44 and is now ready to accept the rest of the insert tungsten carbide composition that forms the body 12 of the insert 10. The powdered tungsten carbide material is deposited into the second insert die cavity 42 and compacted by hydraulic press 48 by forcing ram 50 into cavity 42. The special hardened material of the wear pad 24 then is integrated into the less hard but tougher tungsten carbide material of body 12. A hydraulic pressure of approximately 15 tons per square inch is exerted on the insert tungsten carbide material to form the entire insert. As stated before, the outside dimension of the finished, unsintered insert is slightly larger to account for shrinkage during the sintering process. The completely formed insert 10 then is removed from die cavity 42 with material 24 bonded to the parent material of the body 12 and the formed insert is then sintered in an oven for about two hours at a temperature of about 1400° C.

The end product then is a gage row insert having hardened material on surface 22 of tip 16 of the insert 10 so that this cutting surface 22 immediately adjacent the gage 54 of a borehole 52 will withstand the extra formation exposure in the borehole, thus cutting a true gage that will not pinch a subsequent bit as it is lowered into the borehole.

The larger the tungsten carbide grain size utilized in the insert 10, the softer the final sintered product. Similarly, the more cobalt added to the tungsten carbide powder, the softer the sintered product. Basically, two parameters control the hardness of the sintered tungsten carbide: grain size and the amount of cobalt added to the carbide. Small grain size and a low cobalt percentage result in a hard tungsten carbide material which is highly wear resistant but low in impact resistance.

The wear pad 24, for example, has a tungsten carbide powder with a grain size of three microns with eleven percent cobalt mixed therein. This composition when sintered results in a Rockwell Hardness of $89.4R_A$ (Rockwell Hardness as read on the A scale).

The body 12 of insert 10, for example, has a tungsten carbide powder with a grain size of five microns with sixteen percent cobalt mixed therein. This composition when sintered results in a Rockwell Hardness of $86.4R_A$. The body then is more resistant to impact damage (tougher) and less resistant to wear (wear resistant).

The wear pad, of course, is more wear resistant but less impact resistant. The combination therefore of tungsten carbide materials having different wear resistant properties as taught by the present invention combines the best properties of each material for the gage cutting role of insert 10. These different grades of tungsten carbide combined in the above example may be pressed in its unsintered state at a pressure of about fifteen tons per square inch and sintered in a furnace at a temperature of about 1400° C. for about one-hundred minutes. Moreover, the range of tungsten carbide to percent cobalt may vary from three to four microns tungsten carbide to nine to eleven percent cobalt for the wear pad 24. The range of tungsten carbide to percent cobalt for the insert body material may vary from five to six microns tungsten carbide to fifteen to sixteen percent cobalt.

A text entitled *Cemented Carbides,* by Dr. Paul Schwarzkopf and Dr. Richard Kieffer, published by the Macmillan Company, copyrighted in 1960, is an excellent reference. Pages 14 through 47 particularly provide basic data in the cemented carbide technology.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims the invention may be practiced otherwise than as specifically illustrated and described.

I claim:

1. A method for enhancing the wear resistance of inserts in the gage row of a cone in a roller cone rock bit comprising the steps of:

mixing a first mixture of tungsten carbide powder having a grain size from three to four microns and cobalt powder in the range of nine to eleven percent of the mixture;

mixing a second mixture of tungsten carbide powder having a grain size from five to six microns and cobalt powder in the range of fifteen to sixteen percent of the mixture;

pressing a portion of the first mixture into a wear pad die cavity at a pressure of about fifteen tons per square inch for forming an unsintered wear pad;

positioning the pressed, unsintered wear pad into an insert body die cavity having a wear pad cavity complementary to the wear pad;

pressing a portion of the second mixture into the balance of said body die cavity at a pressure of about fifteen tons per square inch, for forming the body of said insert;

sintering said pressed insert in a furnace for about one hundred minutes at a temperature of about fourteen hundred degrees centrigrade for forming an insert for the gage row of a rock bit with a relatively harder wear resistant pad for contacting formation adjacent the gage of a bore hole and a relatively tougher body; and pressing the body of such inserts into an interference fit in the gage row of a cone of a rock bit in a location wherein the wear pad is adjacent the gage of the rock bit.

2. The method as set forth in claim 1 wherein said first mixture of tungsten carbide and cobalt comprises a tungsten carbide grain size of about three microns with about eleven percent cobalt mixed therein, said second mixture of tungsten carbide and cobalt comprises a tungsten carbide grain size of about five microns with about sixteen percent cobalt mixed therein.

* * * * *